US011435122B2

(12) United States Patent
Muller et al.

(10) Patent No.: US 11,435,122 B2
(45) Date of Patent: Sep. 6, 2022

(54) REFRIGERATION APPARATUS

(71) Applicant: Carrier Corporation, Palm Beach Gardens, FL (US)

(72) Inventors: Raphael Muller, Lyons (FR); Michel Grabon, Bressolles (FR); Jeremy Wallet-Laily, Saint Cyr au mont d'or (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 122 days.

(21) Appl. No.: 16/878,219

(22) Filed: May 19, 2020

(65) Prior Publication Data

US 2020/0378658 A1 Dec. 3, 2020

(30) Foreign Application Priority Data

May 29, 2019 (EP) ..... 19177377

(51) Int. Cl.
*F25B 31/00* (2006.01)
*F25B 43/02* (2006.01)

(52) U.S. Cl.
CPC ..... *F25B 31/004* (2013.01); *F25B 43/02* (2013.01); *F25B 2500/16* (2013.01)

(58) Field of Classification Search
CPC ..... F04B 39/02; F25B 31/004; F25B 31/002; F25B 1/00; F25B 43/02; F25B 49/02;
(Continued)

(56) References Cited

U.S. PATENT DOCUMENTS 3,637,006 A * 1/1972 Decker ..... F24F 11/00 165/236
5,044,167 A 9/1991 Champagne
(Continued)

FOREIGN PATENT DOCUMENTS

CN 207035565 U 2/2018
EP 1119731 B1 3/2003
(Continued)

OTHER PUBLICATIONS

European Search Report for application EP 1917737.9, dated Dec. 6, 2019, 8 pages.

*Primary Examiner* — Henry T Crenshaw
*Assistant Examiner* — Kamran Tavakoldavani
(74) *Attorney, Agent, or Firm* — Cantor Colburn LLP

(57) ABSTRACT

This refrigeration apparatus (1) comprises a main refrigerant circuit (2) including a positive displacement compressor (4), a condenser (6), an expansion valve (8), an evaporator (10), through which a refrigerant circulates successively in a closed loop circulation, and a lubrication refrigerant line (18) in fluid connection with the main refrigerant circuit (2) and connected to the compressor (4) for lubrication of said compressor (4) with the refrigerant. The refrigeration apparatus (1) comprises a refrigerant container (20) connected between the condenser (6) and the expansion valve (8), said refrigerant container (20) being configured to retain a quantity of refrigerant, the lubrication refrigerant line (18) being connected to said refrigerant container (20). The refrigeration apparatus (1) further comprises heating means (28) for heating the refrigerant contained in the refrigerant container (20).

13 Claims, 1 Drawing Sheet

(58) Field of Classification Search
CPC ..... F25B 2500/16; F25B 2500/26; F25B 2700/19; F04C 29/02
USPC ..... 62/193
See application file for complete search history.

(56) References Cited

U.S. PATENT DOCUMENTS

| | | | | |
|---|---|---|---|---|
| 5,050,389 | A | 9/1991 | Wigmore et al. | |
| 6,134,911 | A | 10/2000 | Kishimoto et al. | |
| 7,337,625 | B1 * | 3/2008 | Cowans | F25B 41/31 62/210 |
| 8,104,298 | B2 | 1/2012 | Sishtla | |
| 9,518,767 | B2 | 12/2016 | Jandal et al. | |
| 9,803,934 | B2 | 10/2017 | Smith et al. | |
| 2001/0037651 | A1 * | 11/2001 | Butterworth | F25B 31/008 62/468 |
| 2008/0276644 | A1 * | 11/2008 | Eichholz | A47L 15/481 62/476 |
| 2011/0194960 | A1 | 8/2011 | Wu et al. | |
| 2017/0176076 | A1 | 6/2017 | Johnson | |
| 2018/0045470 | A1 | 2/2018 | Smith et al. | |
| 2018/0128520 | A1 | 5/2018 | Lapp et al. | |
| 2020/0208889 | A1 * | 7/2020 | Domyo | F25B 45/00 |
| 2020/0326112 | A1 * | 10/2020 | Hatanaka | F25B 49/02 |

FOREIGN PATENT DOCUMENTS

| | | | |
|---|---|---|---|
| EP | 1400765 | A2 | 3/2004 |
| EP | 1851491 | B1 | 4/2014 |
| EP | 3120022 | B1 | 2/2018 |
| JP | H04187948 | A | 7/1992 |
| JP | 2001201195 | A | 7/2001 |
| WO | 0022359 | A1 | 4/2000 |
| WO | 2014130530 | A1 | 8/2014 |
| WO | 2017215493 | A1 | 12/2017 |
| WO | 2018038918 | A1 | 3/2018 |
| WO | 2018038926 | A1 | 3/2018 |
| WO | 2018052694 | A1 | 3/2018 |

* cited by examiner

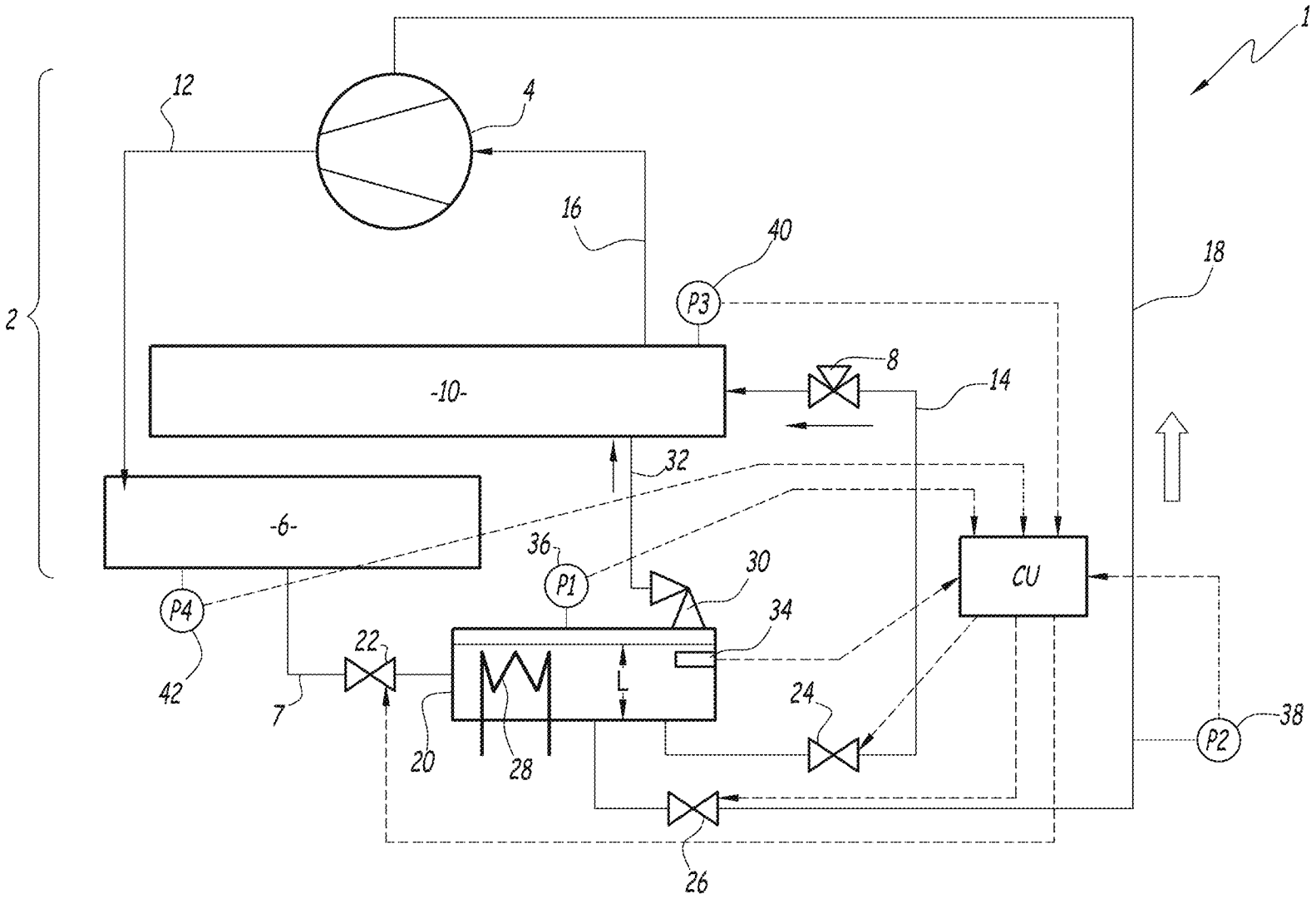
1
18
38
P2
CU
14
8
24
40
P3
30
34
26
32
16
L
36
P1
28
4
-10-
20
22
-6-
7
12
P4
42
2

REFRIGERATION APPARATUS

FOREIGN PRIORITY

This application claims priority to European Patent Application No. 19177377.9, filed May 29, 2019, and all the benefits accruing therefrom under 35 U.S.C. § 119, the contents of which in its entirety are herein incorporated by reference.

BACKGROUND

The present invention concerns a refrigeration apparatus.

A refrigeration apparatus is known from EP 1 400 765, comprising a refrigerant circuit including a screw compressor, a condenser, an expansion valve and an evaporator. This known apparatus comprises a bypass flow passage, branching at a part of said refrigerant circuit between the condenser and the expansion valve, routing through throttle means, and communicating with a rotor cavity and with bearings of the screw compressor. Lubrication of the compressor is achieved by the same fluid that is also used as refrigerant in the circuit, and in the absence of oil.

For successfully lubricating the rotor cavity and the bearings during the start of the refrigeration apparatus, one must ensure that a sufficient amount of lubrication refrigerant is present in liquid state in the rotor cavity and in the bearings, to avoid potential damages of the compressor. In some cases, depending on the location of the compressor with respect to the other components of the main refrigerant circuit, the liquid refrigerant may not be available in sufficient quantity in the bypass flow passage to properly lubricate the compressor. Before a start of the refrigeration apparatus, the liquid refrigerant present in the lubrication line may not be available in sufficient quantity to properly lubricate the compressor, or might have migrated towards a lower part of the main circuit due to gravity.

Standard refrigeration apparatuses may comprise a starting pump, which is activated during the start of the refrigeration apparatus to initiate refrigerant circulation and notably provide the compressor with a fresh flow of liquid refrigerant and thereby allow the compressor to start properly and initiate the steady-state operation of the apparatus. Such pumps are used rarely, and have a substantial cost and induce potential maintenance issues due to the moving parts of the pumps.

SUMMARY

An aim of the invention is to provide a refrigeration apparatus where proper lubrication of the compressor by the refrigerant is guaranteed during the start of the refrigeration apparatus by means less costly than pumps.

To this end, the invention concerns a refrigeration apparatus comprising a main refrigerant circuit including a positive displacement compressor, a condenser, an expansion valve, and an evaporator, through which a refrigerant circulates successively in a closed loop circulation, a lubrication refrigerant line in fluid connection with the main refrigerant circuit and connected to the compressor for lubrication of said compressor with the refrigerant.

The refrigeration apparatus is characterized in that it comprises a refrigerant container connected between the condenser and the expansion valve, the refrigerant container being configured to retain a quantity of refrigerant, the lubrication refrigerant line being connected to said refrigerant container, and in that it comprises heating means for heating the refrigerant contained in the refrigerant container.

Thanks to the invention, during a start of the refrigeration apparatus, the circulation of liquid refrigerant towards the compressor is obtained by the pressure difference between the refrigerant container and the rest of the main circuit, prompting spontaneous refrigerant migration towards the compressor. The hazard of damage of the compressor due to an insufficient amount of refrigerant during a start of the refrigeration apparatus is therefore avoided without having to rely on a costly pump.

According to further aspects of the invention that are advantageous but not mandatory, such a refrigeration apparatus may incorporate one or several of the following features: The refrigeration apparatus comprises means for allowing the circulation of refrigerant towards the compressor in the lubrication refrigerant line if a refrigerant pressure differential between a container pressure in the refrigerant container and a circuit pressure, in other parts of the main refrigerant circuit isolated from the refrigerant container prior to a starting of the refrigeration apparatus, is above a threshold. The means for allowing the circulation of refrigerant towards the compressor comprises a refrigerant supply valve provided on the lubrication refrigerant line downstream the refrigerant container and upstream the compressor, a first pressure sensor measuring the container pressure in the refrigerant container, at least one second pressure sensor measuring the circuit pressure, and a control unit configured to compute the pressure differential between the container pressure and the circuit pressure, compare the pressure differential to the threshold and open the refrigerant supply valve during a starting operation of the refrigeration apparatus if the pressure differential is above the threshold.—The refrigerant supply valve is a solenoid valve that is controlled by the control unit. If the pressure differential is inferior to the threshold, the heating means are activated by the control unit until the pressure differential is superior to the threshold. The at least one second pressure sensor comprises one or more of a pressure sensor inside the condenser, a pressure sensor inside the evaporator, and a pressure sensor on the lubrication refrigerant line downstream the refrigerant supply valve. The refrigeration apparatus comprises a first valve upstream the refrigerant container and a second valve downstream the refrigerant container, configured to isolate the refrigerant container from the main refrigerant circuit. The first and second valves and the refrigerant supply valve are closed during stand-by periods of the refrigeration apparatus. The first and second valves are solenoid valves that are controlled by a control unit of the refrigeration apparatus. The refrigerant container comprises detection means of a level of liquid refrigerant in the refrigerant container. The refrigerant container is directly connected to a line of the main refrigerant circuit connecting the condenser to the expansion valve or to a line parallel to the line of the main refrigerant circuit connecting the condenser and the expansion valve. The heating means comprise an electrical device using Joule effect. The refrigerant container comprises a pressure relief valve. The compressor is chosen between at least a scroll compressor, a screw compressor, a piston compressor, a rotary compressor. The refrigeration apparatus operates an oil free refrigerant cycle.

DRAWING DESCRIPTION

Exemplary embodiments according to the invention and including further advantageous features of the invention are explained below, in referenced to the attached drawings, in which: FIG. 1 is a synoptic drawing showing a refrigeration apparatus according to the invention.

DETAILED DESCRIPTION

FIG. 1 shows a refrigeration apparatus 1, comprising a main refrigerant circuit 2 through which a refrigerant circulates in a closed loop circulation. The main refrigerant circuit 2 comprises four main components: a positive displacement compressor 4, also called volumetric compressor, a condenser 6, an expansion valve 8, and an evaporator 10. The refrigerant circulates successively in these four components according to a thermodynamic cycle.

Preferably, in a steady-state, during high load operation of the refrigeration apparatus 1: in the compressor 4, the refrigerant is in a gaseous state, and is compressed from a low pressure to a high pressure, which raises the temperature of the refrigerant from a low temperature to a high temperature; in a discharge line 12 connecting the compressor 4 to the condenser 6, the refrigerant is in a gaseous state, or essentially gaseous state, and is at the high temperature and the high pressure; in the condenser 6, the refrigerant is in a bi-phasic state, including gaseous and liquid refrigerant, and is condensed to a liquid state by the condenser 6; in a line 14 connecting the condenser 6 to the expansion valve 8, the refrigerant is in a liquid state, or essentially liquid state, is at the high pressure, and may be at the high temperature or at a temperature between the high temperature and the low temperature; in the expansion valve 8, the refrigerant is brought to the low pressure, which lowers the temperature of the refrigerant to the low temperature while evaporating the refrigerant to the bi-phasic state; in a line 15 connecting the expansion valve 8 to the evaporator 10, the refrigerant is in a biphasic-state, where a major part is liquid and a smaller part is gaseous, and the refrigerant is at a low temperature and a low pressure; in the evaporator 10, the refrigerant is in a bi-phasic state, including gaseous and liquid refrigerant, and is evaporated to a gaseous state by the evaporator 10; in a suction line 16 connecting the evaporator 10 to the compressor 4, the refrigerant is in a gaseous state, or essentially gaseous state, at the low pressure and at a low temperature, or at a temperature between the low and the high temperature.

For example, the low temperature is approximately between 5-10° C., the high temperature is approximately between 35-40° C., the low pressure is approximately between 3-4 bar, and the high pressure is approximately between 6-10 bar.

Considering the above, the main circuit 2 comprises a high-pressure part, consisting in the discharge line 12, the condenser 6 and the line 14, and a low-pressure part, consisting in the line 15, the evaporator 10 and the suction line 16.

In one part of the main circuit 2, which covers only a portion of the high-pressure part, preferably consisting in the condenser 6 and the line 14, the refrigerant is mostly in liquid state and under high pressure.

The positive-displacement compressor 4 may be chosen between at least a scroll compressor, a screw compressor, a piston compressor, a rotary compressor, or a Roots compressor. The compressor 4 comprises non-shown rotors and bearings.

To insure the proper operation of the compressor 4, it is essential that at least the rotors, and optionally, the bearings are sufficiently lubricated with a liquid lubricant.

The refrigerant of the refrigeration apparatus 1 is a fluid material chosen to ensure both functions of refrigerant and lubricant. Preferably, the refrigerant used in the apparatus is a hydrofluoroolefin (HFO), for example R1234ze (1,3,3,3-tetrafluoroprop-1-ene). There is therefore no lubrication oil present in the main refrigerant circuit 2. The refrigeration apparatus 1 is operating an oil-free refrigerant cycle.

In the condenser 6 and between the condenser 6 and the expansion valve 8, where the refrigerant of the main circuit 2 it mostly in liquid state and at high pressure, is the part of the main circuit 2 where the refrigerant is in the most appropriate state to be used as lubricant.

The refrigeration apparatus 1 comprises a lubrication refrigerant line 18, in fluid connection with the main refrigerant circuit 2 and connected to the compressor 4 for lubrication of said compressor 4 with the refrigerant.

The refrigeration apparatus 1 also comprises a refrigerant container 20 located between the condenser 6 and the expansion valve 8. The refrigerant container 20 is connected to the condenser 6 by a line 7 and to the expansion valve 8 by the line 14. In such a case, the refrigerant container 20 is directly connected to a line, formed by the lines 7 and 14, of the main refrigerant circuit 2 connecting the condenser 6 to the expansion valve 8. The refrigerant container 20 is configured to retain a quantity of refrigerant in liquid state, so that a minimal amount of refrigerant can stay in the refrigerant container 20 during a standby period of the refrigeration apparatus 1. The lubrication refrigerant line 18 is connected to the refrigerant container 20.

The aim of the refrigerant container 20 is to retain a quantity of liquid refrigerant sufficient for lubricating the compressor 4 at starting of the refrigeration apparatus 1. To obtain a flow of refrigerant contained in the refrigerant container 20 towards the lubrication refrigerant line 18 and towards the compressor 4, the refrigeration apparatus I comprises heating means for heating the refrigerant contained in the refrigerant container 20. The heating means may comprise an electrical device 28 using Joule effect, e.g. an electrical heater. By heating the refrigerant in the refrigerant container 20, refrigerant pressure in the refrigerant container 20 will increase, ultimately becoming higher than the refrigerant pressure outside the refrigerant container 20. The refrigerant of the refrigerant container 20 will then spontaneously migrate towards an area of the refrigeration apparatus 1 having a lower refrigerant pressure, and thus towards the compressor 4 via the lubrication refrigerant line 18. The refrigeration apparatus 1 does therefore not have to rely on a costly refrigerant pump to initiate refrigerant flow towards the compressor 4.

Such a refrigerant migration is obtained if a sufficient pressure differential exists between the refrigerant container 20 and the other parts of the refrigeration apparatus 1.

The refrigeration apparatus 1 therefore comprises means for allowing the circulation of refrigerant towards the compressor 4 in the lubrication refrigerant line 18 if a refrigerant pressure differential $\Delta P$ between a container pressure P1 in the refrigerant container 20 and a circuit pressure P2 in other parts of the main refrigerant circuit 2, isolated from the refrigerant container 20 prior to a starting of the refrigeration apparatus 1, is above a threshold T.

This means comprise: a refrigerant supply valve 26 provided on the lubrication refrigerant line 18 downstream the refrigerant container 20 and upstream the compressor 4; a first pressure sensor 36 measuring the container pressure P1 in the refrigerant container 20; at least one second pressure sensor 38 measuring the circuit pressure P2; a control unit CU (e.g., a controller) configured to compute the pressure differential AP between the container pressure P1 and the circuit pressure P2, compare the pressure differential AP to the threshold I, and open the refrigerant supply valve 26 during a starting operation of the refrigeration apparatus 1 if the pressure differential AP is above the threshold T.

The refrigerant supply valve 26 may be a solenoid valve controlled by the control unit CU.

The pressure sensor 38 may be provided on the lubrication refrigerant line 18 downstream the refrigerant supply valve 26. In such a case the circuit pressure P2 is the refrigerant pressure in the lubrication refrigerant line 18 upstream the compressor 4.

The refrigeration apparatus 1 may also comprise, in addition to the pressure sensor 38 or in alternative, a pressure sensor 40 inside the evaporator 10 and measuring a refrigerant pressure P3 inside the evaporator 10, and a pressure sensor 42 inside the condenser 6 and measuring a refrigerant pressure P4 inside the condenser 6. The pressure differential ΔP may be computed by the control unit CU using only one or a combination of the pressures P2, P3 and P4.

If the pressure differential ΔP is inferior to the threshold T, the heating means 28 are activated by the control unit CU until the pressure differential ΔP is superior to the threshold T.

The refrigeration apparatus 1 comprises a valve 22 upstream the refrigerant container 20 and a valve 24 downstream the refrigerant container 20, configured to isolate the refrigerant container 20 from the main refrigerant circuit 2. The valve 22 is provided on the line 7, while the valve 24 is provided on the line 14. The valves 22 and 24 may be solenoid valves controlled by the control unit CU.

The refrigerant container 20 may comprises detection means 34 (e.g., a liquid level float sensor) of the level L of liquid refrigerant in the refrigerant container 20. The detection means 34 may send data to the control unit CU concerning the level L, with the control unit CU allowing the starting of the refrigeration apparatus I upon checking that a minimal level of refrigerant is present in the refrigerant container 20.

The operation of the refrigeration apparatus 1 is described below.

During steady-state operation, the valve 22, the valve 24 and the refrigerant supply valve 26 are opened, allowing free flow of refrigerant in the refrigerant container 20 and in the lubrication refrigerant line 18.

If a stand-by period of the refrigeration apparatus 1 occurs, the valve 22, the valve 24 and the refrigerant supply valve 26 are closed by the control unit CU, to retain refrigerant in the refrigerant container 20 for use during an upcoming starting operation.

Upon start of the refrigeration apparatus, a pressure check is done by the control unit CU to check if the pressure differential AP is above the threshold T. If not, the heating device 28 is started by the control unit CU.

The pressure check is done again, with the heating device 28 activated, until the pressure differential AP is above the threshold T. Once the pressure differential ΔP is obtained, the heating device 28 is stopped by the control unit CU, and the refrigerant supply valve 26 is opened. At this step, the level L of the refrigerant container may be checked by the control unit CU to guarantee that a sufficient level L of refrigerant is available.

The compressor 4 can then be started, and the valves 22 and 24 be opened to reach steady state of the refrigeration apparatus 1.

As an optional embodiment, the refrigeration apparatus 1 may comprise a pressure relief valve 30 provided in the refrigerant container 20, connected to a relief line 32 connected to the evaporator 10, or to another part of the main refrigerant circuit 2. The pressure relief valve 30 aims at avoiding an overpressure in the refrigerant container 20 during use of the heating device 28 that may lead to destruction of the refrigerant container 20.

According to a non-shown embodiment, the refrigerant container 20 may be connected to a line parallel to the line 14 of the main refrigerant circuit 2 that connects the condenser 6 and the expansion valve 8 in absence of the refrigerant container 20 directly between the condenser 6 and the expansion valve 8.

The technical features of the embodiments and variants described here above may be combined to form new embodiments of the invention within the scope of the claims.

What is claimed is:

1. A refrigeration apparatus comprising:

a main refrigerant circuit including a positive displacement compressor, a condenser, an expansion valve, and an evaporator, through which a refrigerant circulates successively in a closed loop circulation;

a lubrication refrigerant line in fluid connection with the main refrigerant circuit and connected to the compressor for lubrication of said compressor with the refrigerant;

wherein:

the refrigeration apparatus comprises a refrigerant container connected between the condenser and the expansion valve, said refrigerant container being configured to retain a quantity of refrigerant, the lubrication refrigerant line being connected to said refrigerant container, the refrigeration apparatus comprises an electrical heater for heating the refrigerant contained in the refrigerant container;

wherein said refrigeration apparatus comprises means for allowing the circulation of refrigerant towards the compressor in the lubrication refrigerant line if a refrigerant pressure differential, between a container pressure in the refrigerant container and a circuit pressure in other parts of the main refrigerant circuit isolated from the refrigerant container prior to a starting of the refrigeration apparatus, is above a threshold.

2. The A refrigeration apparatus according to claim 1, wherein said means comprises:

a refrigerant supply valve provided on the lubrication refrigerant line downstream the refrigerant container and upstream the compressor;

a first pressure sensor measuring the container pressure in the refrigerant container;

at least one second pressure sensor measuring the circuit pressure;

a controller configured to compute the pressure differential between the container pressure and the circuit pressure, compare the refrigerant pressure differential to the threshold and open the refrigerant supply valve during the starting of the refrigeration apparatus if the refrigerant pressure differential is above the threshold.

3. The A refrigeration apparatus according to claim 2, wherein the refrigerant supply valve is a solenoid valve that is controlled by the control controller.

4. The refrigeration apparatus according to claim 2, wherein if the refrigerant pressure differential is inferior to the threshold, the electrical heater is activated by the controller until the refrigerant pressure differential is superior to the threshold.

5. The refrigeration apparatus according to claim 2, wherein said at least one second pressure sensor comprises one or more of a pressure sensor inside the condenser, a pressure sensor inside the evaporator, and a pressure sensor on the lubrication refrigerant line downstream the refrigerant supply valve.

6. A refrigeration apparatus according to claim 1, wherein said refrigeration apparatus comprises a first valve upstream the refrigerant container and a second valve downstream the refrigerant container, configured to isolate the refrigerant container from the main refrigerant circuit.

7. A refrigeration apparatus according to claim 6, wherein the first valve and the second valve and and the refrigerant supply valve are closed during stand-by periods of the refrigeration apparatus.

8. A refrigeration apparatus according to claim 6, wherein the first and second valves are solenoid valves that are controlled by a controller of the refrigeration apparatus.

9. A refrigeration apparatus according to claim 1, wherein the refrigerant container comprises a liquid level float sensor to detect a level of liquid refrigerant in the refrigerant container.

10. A refrigeration apparatus according to claim 1, wherein the refrigerant container is directly connected to a line of the main refrigerant circuit connecting the condenser to the expansion valve or to a line parallel to the line of the main refrigerant circuit connecting the condenser and the expansion valve.

11. A refrigeration apparatus according to claim 1, wherein the refrigerant container comprises a pressure relief valve.

12. The refrigeration apparatus according to claim 1, wherein the compressor is chosen between at least a scroll compressor, a screw compressor, a piston compressor, a rotary compressor.

13. A refrigeration apparatus according to claim 1, wherein said refrigeration apparatus operates an oil free refrigerant cycle.

* * * * *